US010227717B2

(12) United States Patent
Pedrini

(10) Patent No.: US 10,227,717 B2
(45) Date of Patent: Mar. 12, 2019

(54) FOOT-COVERING GARMENT, METHOD FOR MANUFACTURING SUCH A FOOT-COVERING GARMENT AND A CIRCULAR MACHINE FOR KNITWEAR OR HOSIERY

(71) Applicant: STEPS HOLDING B.V., Oost West en Middelbeers (NL)

(72) Inventor: Gianmario Pedrini, Calcinato (IT)

(73) Assignee: STEPS HOLDING B.V., Oost West en Middelbeers (NL)

( * ) Notice: Subject to any disclaimer, the term of this patent is extended or adjusted under 35 U.S.C. 154(b) by 164 days.

(21) Appl. No.: 15/123,958

(22) PCT Filed: Mar. 4, 2015

(86) PCT No.: PCT/EP2015/054518

§ 371 (c)(1),
(2) Date: Sep. 6, 2016

(87) PCT Pub. No.: WO2015/135809

PCT Pub. Date: Sep. 17, 2015

(65) Prior Publication Data

US 2017/0016156 A1 Jan. 19, 2017

(30) Foreign Application Priority Data

Mar. 10, 2014 (IT) ..... BS2014A0055

(51) Int. Cl.
*D04B 1/26* (2006.01)
*D04B 1/18* (2006.01)
(Continued)

(52) U.S. Cl.
CPC ..... *D04B 1/26* (2013.01); *D04B 1/18* (2013.01); *D04B 9/46* (2013.01); *D04B 15/50* (2013.01)

(58) Field of Classification Search
CPC . D04B 1/24; D04B 1/26; D04B 1/265; D04B 9/46; D04B 9/54; D04B 1/18
See application file for complete search history.

(56) References Cited

U.S. PATENT DOCUMENTS 2,001,293 A 5/1935 Wilson
2,400,692 A * 5/1946 Herbert ..... A43B 1/04 36/10

(Continued)

FOREIGN PATENT DOCUMENTS

BS 2013A000101 1/2015
CN 1121828 9/2003

(Continued)

OTHER PUBLICATIONS

International Search Report for PCT/EP2015/054518 dated Mar. 31, 2015.

(Continued)

*Primary Examiner* — Danny Worrell
(74) *Attorney, Agent, or Firm* — Ladas & Parry, LLP

(57) ABSTRACT

The present invention relates to a seamless foot-covering garment made of knitted courses, a method for manufacturing thereof as well as a respective circular machine for hosiery and knitwear. The foot-covering garment made of knitted courses, comprises a heel portion, a toe portion, a middle portion located between the heel portion and the toe portion and an opening between said heel portion, said middle portion and said toe portion for the insertion of an user's foot. The toe portion and the heel portion are aligned along a longitudinal direction. At said opening the middle portion ends with a right side edge and a left side edge. The garment is seamlessly knitted as a whole. At least one or both the right and left side edges comprise at least one elastic portion made up by a plurality of stretch stitches located at an end of knitted courses. The stretch stitches are composed (Continued)

of at least one main thread of the foot-covering garment knitted with at least one elastic thread. The elastic thread extends with no interruption in said at least one elastic portion, in that it is not cut at each knitted course of said at least one elastic portion.

12 Claims, 5 Drawing Sheets

(51) Int. Cl.
*D04B 9/46* (2006.01)
*D04B 15/50* (2006.01)

(56) References Cited

U.S. PATENT DOCUMENTS

| | | | | |
|---|---|---|---|---|
| 2,848,885 | A | 8/1958 | Goodman | |
| 4,216,662 | A * | 8/1980 | Harris, Jr. | D04B 1/26 66/185 |
| 4,255,949 | A * | 3/1981 | Thorneburg | A41B 11/00 2/239 |
| 5,095,720 | A * | 3/1992 | Tibbals, Jr. | D04B 9/12 66/104 |
| 5,791,163 | A * | 8/1998 | Throneburg | A41B 11/02 2/239 |
| 6,173,589 | B1 * | 1/2001 | Hayes, Jr. | A41B 11/10 2/239 |
| 6,308,438 | B1 * | 10/2001 | Throneburg | A43B 1/02 36/11 |
| 6,415,632 | B1 * | 7/2002 | Vesnaver | A41B 11/10 66/185 |
| 6,931,762 | B1 * | 8/2005 | Dua | A43B 1/04 12/142 G |
| 7,738,991 | B2 * | 6/2010 | Klumpp | D04B 1/26 66/185 |
| 7,937,972 | B2 | 5/2011 | Busi | |
| 2003/0182974 | A1 * | 10/2003 | Ando | D04B 1/108 66/8 |

FOREIGN PATENT DOCUMENTS

| | | | |
|---|---|---|---|
| CN | 101646817 | A | 2/2010 |
| DE | 931000 | | 7/1955 |
| DE | 2020130082000 | U1 | 9/2013 |
| EP | 0632972 | | 1/1995 |
| EP | 1133245 | | 9/2001 |
| EP | 3019653 | | 5/2016 |
| IT | BS20130101 | A1 | 1/2015 |
| WO | 2000/019846 | | 4/2000 |
| WO | 2008/072048 | | 6/2008 |
| WO | 2015/004094 | | 1/2015 |

OTHER PUBLICATIONS

Written Opinion for PCT/EP2015/054518 dated Mar. 31, 2015.
Office action from Chinese Patent Application No. 201580010775.X dated May 22, 2017 with its English translation and partial English translation of search report.
PCT International Preliminary Report on Patentability Chapter I from PCT/EP2015/054518 dated Sep. 13, 2016.

* cited by examiner

FOOT-COVERING GARMENT, METHOD FOR MANUFACTURING SUCH A FOOT-COVERING GARMENT AND A CIRCULAR MACHINE FOR KNITWEAR OR HOSIERY

CROSS REFERENCE TO RELATED APPLICATIONS

The present application is the U.S. national phase of PCT Application No. PCT/EP2015/054518 filed on Mar. 4, 2015, which claims priority to Italian Patent Application No. BS2014A000055 filed on Mar. 10, 2014 and entitled "FOOT-COVERING GARMENT, METHOD FOR MANUFACTURING SUCH A FOOT-COVERING GARMENT AND A CIRCULAR MACHINE FOR KNITWEAR OR HOSIERY", the disclosures of which are incorporated herein by reference in their entireties.

FIELD OF THE INVENTION

The invention relates to a foot-covering garment made of knitted courses, comprising a heel portion, a toe portion, a middle portion located between the heel portion and the toe portion and an opening between said heel portion, said middle portion and said toe portion for the insertion of an user's foot, wherein the toe portion and the heel portion are aligned along a longitudinal direction, and wherein at said opening, the middle portion ends with a right side edge and a left side edge, which garment is seamlessly knitted as a whole.

The invention further relates to a method for manufacturing such a garment and a circular machine for hosiery and knitwear.

The present invention relates in general to the field of hoses, and similar garments, and relates in particular to a garment having the shape of a foot-covering hose of the type known in Italy with the name of 'fantasmino'.

STATE OF THE ART

Foot-covering garments are known to be fitted on the foot in order to become substantially not visible once a shoe has been put on. With the terms 'foot-covering garment' and 'underfoot sock' a garment is referred that is adapted to cover the toe, sole and heel portions only of a wearer's foot, as well as part of the lateral portion thereof, allowing the instep and the ankle to be uncovered.

Such garments generally comprise a toe portion, a sole portion, two lateral portions and a heel portion. Usually, then, at least the toe and heel portions have a top elastic edge in order to correctly hold the garment on the foot when put on.

The foot-covering garment is preferably made up on circular machines for hosiery and knitwear and can be realized as a whole, that is to say free from seams to carry out outside the same machine at the toe or heel portion, and free from seams for fastening elastic portions.

EP 0632972, by the same inventor of the present patent Application, relates to a foot-covering garment having two opposite parts having the shape of pouch heel and integrally joined to a middle area, and having an elastic edge realized and knitted with the two heel-shaped parts. EP 0632972 also relates to a method for manufacturing such a garment integrally on a circular machine for hosiery. Such specific garment configuration and method thereof, however, are limited in connection with the size of the garment itself. In fact a closed-loop elastic edge at the two heel-shaped parts limits the length extent of the garment. In order to fit to large sizes, over number 42, the foot-covering garment has to be realized of an elastic material which makes it extensible. This however limits the selection of usable yarns; for example natural fibers such as cotton, which are by nature little extensible, have to be unavoidably excluded.

In order to obviate such a drawback, EP 1133245 puts forward a garment having a sole, a partial upper foot region, a heel, and a toe. The opening for the insertion of the foot is provided in a middle position between toe and sole, at the partial upper foot region. The length of such a partial upper foot region can vary according to the needs in order to allow the realization of garments of different size. The elastic edge is provided at the toe and heel portions only; on the contrary, at the partial upper foot region no edge is provided. Since the ends of the upper foot partial portions are free from any type of finishing edge, they are prone to bend on themselves, making a thickness. Furthermore, such portions are highly extensible and thus, in order to ensure that the worn under-foot garment remains correctly fitted on when subjected to friction by the shoe as the wearer is moving, the presence of the elastic edge at the heel and toe portion is needed.

WO2008072048A1 also disclosed a foot-covering garment being seamlessly knitted as a whole and being provided with an elastic edge at the toe and heel portions only.

OBJECTS AND SUMMARY OF THE INVENTION

The present invention has been conceived just with the aim of compensating for the drawbacks of the known art by putting forward a foot-covering garment provided with at least one elastic portion at least at one of the side portions to thereof, allowing at the same time to realize foot-covering garments of any length and size.

Such objects are achieved with the knit foot-covering garment according to the invention in that at least one or both the right and left side edges comprise at least one elastic portion made up by a plurality of stretch stitches located at an end of knitted courses, which stretch stitches are composed of at least one main thread of the foot-covering garment knitted with at least one elastic thread wherein said elastic thread extends with no interruption in said at least one elastic portion, in that it is not cut at each knitted course of said at least one elastic portion.

With the term "knitted course" is meant the row of stitches composing each of the curved lines of stitches extending in a transversal direction and composing the whole garment.

Advantageously, thus, with respect to the foot-covering garments until now proposed, the under-foot garment of the present invention is provided with at least one elastic portion at the at least one of the right and left side edges, preferably at both the ends of the middle portion, at the opening. Since such elastic portions are provided at the right and/or left side edges of the middle portion, independently from the toe and heel portions, they do not generate any constraint in the extent of the middle portion and thus of the under-foot garment itself. Furthermore, each elastic portion comprises a sequence of stretch stitches, obtained by knitting one elastic thread with at least one main thread, also defined ground yarn. Consequently, due to the presence of the elastic thread, each elastic portion exerts its function of correctly holding the foot-covering garment on the user's foot also in absence of any type of edge at the heel and/or toe portion.

The elastic thread extends with no interruption in each elastic portion; this means that the elastic thread is not cut at each course of the elastic portion. The thread extends in a single piece along each elastic portion starting from an initial end, up to a final end.

Advantageously, at least the right side edge or the left side edge has only one to elastic portion respectively extending for the whole length of the right or left side edge, or at a part thereof. This means that each one of the two side edges, or at least one of them, has a single elastic portion and that such a portion can coincide with whole the respective side edge, or else with a part thereof, for example with a middle portion thereof.

Alternatively, at least the right side edge and/or at least the left side edge both have two or more elastic portions that are consecutive in the longitudinal direction, interspaced one another by a portion of the right side edge or the left side edge, respectively. According to this configuration the right and/or left side edges can have an alternation of portions with stitches of the main thread interspaced by elastic portions, in other terms stretch lengths of edge which are alternated with not-stretch lengths of edge.

In both the described configurations, however one or more elastic portions could be provided at only one right or left side edge, for example in order to obtain left or right foot-covering garments, wherein only the edge intended to be worn on the inner portion of a user's foot is provided with one or more elastic portions.

Otherwise both the right and left side edges can each have one or more elastic portions.

In a particularly preferred configuration, both the right side edge and the left side edge have only one elastic portion each, extending for the whole length of the respective side edge, or at a length thereof. The presence of an elastic portion at both right and left side edges ensures an optimal holding of the garment, also in absence of elastic edges at the toe and/or heel thereof.

Each elastic portion comprises at least one row of stitches stretch in the longitudinal direction. In a direction orthogonal to the longitudinal direction, the elastic portion comprises at least one row, but preferably at least ten or more rows which are placed side by side according to needs such to form a matrix of stretch stitches. The number of stretch stitches placed side by side in a direction orthogonal to the longitudinal direction determines the extent in transversal direction of each stretch portion. A better distribution of the pressure exerted on the user's foot by the elastic portion corresponds to a larger transversal extent.

Advantageously, a conventional elastic edge can be combined with the toe and/or heel portions.

Alternatively, in a particularly preferred configuration, a restraining portion can be combined with the toe and/or heel portions, as described and claimed in the Italian Patent Application BS2013A000101, filed on Jul. 10, 2013. This document is incorporated by reference.

Effectively the combination of elastic portions of the right and/or left side edges with restraining portions at the toe and/or heel portions provides the foot-covering garment with a very high comfort; in addition, the so-shaped garment is still correctly worn even if subjected to friction by a shoe when the user moves, also in absence of elastic edges combined with the toe and/or heel of the garment.

The invention, in an additional aspect thereof, concerns a method for manufacturing a seamless foot-covering garment made of knitted courses, wholly on a circular machine for knitwear or hosiery provided with a rotating cylinder able to be selectively and rotationally activated in reciprocating motion, carrying a plurality of needles able to be selectively activated, and provided with means for feeding at least one main thread and at least one elastic thread to the needles, comprising the steps of:

a) knitting at least one main thread through part of the needles of the rotating cylinder activated in reciprocating motion, in order to realize a toe portion or a heel portion (4) of the foot-covering garment;

b) at the end of the step a) knitting at least one main thread through a needle set of the rotating cylinder, activated in reciprocating motion, in order to realize the middle portion with the respective right and left side edges, wherein said needle set comprises a left set of end needles, composed of one or more needles, and a right set of end needles, composed of one or more needles, and a plurality of middle needles with respect to the left and right sets of end needles, c) at the end of step b) knitting at least one main thread through part of the needles of the rotating cylinder activated in reciprocating motion, in order to realize the heel portion or the toe portion, respectively, of the foot-covering garment, wherein the toe (2) and heel (4) portions are aligned along a longitudinal direction. The method is characterized by the step of:

b') during the step b) and during at least two runs of the rotating cylinder, activating all the needles of said needle set in order to making up two corresponding knitted courses and feed, to the needle/s of the left set of end needles and/or to the needle/s of the right set of end needles, a respective elastic thread along with at least one main thread, to make up at least one elastic portion of the left and/or right edges composed of a plurality of stretched stitches located at an end of knitted courses, which stretch stitches are composed of at least one main thread and of the elastic thread, wherein said elastic thread extends with no interruption in each elastic portion, in that it is not cut at each knitted course of the elastic portion.

More in detail, the method provides to knit at least one main thread through part of the needles of the rotating cylinder activated in reciprocating motion. Initially a toe portion or a heel portion of the foot-covering garment is realized; then at least one main thread is knitted with a needle set of the rotating cylinder, in order to realize the middle portion with the respective right and left side edges; the needle set comprises, in its turn, a left set of one or more end needles and a right set of one or more end needles and a plurality of middle needles with respect to the right and left sets of end needles; then it carries on by knitting at least one main thread through part of the needles of the rotating cylinder in order to realize the heel portion or the toe portion of the foot-covering garment, respectively, the toe and heel portions being aligned along a longitudinal direction.

According to the invention, the step necessary to realize the middle portion with the respective right and left side edges, provides to activate all the needles of the needle set and, during at least two runs of the rotating cylinder, to made up two corresponding knitted courses by feeding, to each needle of the left set of end needles and/or each needle of the right set of end needles, a respective elastic thread along with at least one main thread, in order to made up at least one elastic portion of the left and/or right edges composed of a plurality of stretch stitches of the main thread and of the respective elastic thread.

As previously mentioned, with the term "knitted course" is meant the row of stitches made up during each run of the rotating cylinder and which composes each of the curved lines of stitches extending in a direction substantially orthogonal to the longitudinal direction and forming the foot-covering garment. In fact, during the manufacture of the foot-covering garment, the rotating cylinder activated in reciprocating motion performs a sequence of partial turns or half-turns, named runs, which are alternately consecutive clockwise and counterclockwise, a respective knitted course being formed at each of them. Advantageously, the making up of the foot-covering garment starts with the realization of a heel or toe portion as usual, carries on with the making up of the middle portion and contemporaneously of a right and left side edges, and ends with the implementation of a toe or heel portion. The sequence with which the foot-covering garment is manufactured according to the present invention is similar to the usually used one, except than in the making up of the middle portion and the side edges, the needles are selected and fed with a new mode in order to obtain, at the same time, the making up of one or more elastic portions at one or both the side edges. In fact, at each run of the cylinder by conveniently selecting the position of the needles of the right and/or left sets of end needles and carrying them in a position in which, in addition to at least one main thread, they take the elastic thread to knit, the so called stretch stitches are obtained that compose each elastic portion. Due to this particular knitting method the entire under foot garment can be obtained, provided with at least one elastic portion at one or both the side edges, at the same time needed for manufacturing a foot-covering garment produced according to the known art, but free from any side elastic portion. According to the present invention each elastic portion, therefore, is formed as an integral part of the foot-covering garment during the knitting steps needed for making up the garment itself directly on the circular machine for knitwear or hosiery.

Preferably, the step needed for making up a middle portion with side edges provided with elastic portions is carried out in two modes depending on the number of needles of each set of end needles. Specifically, in case of sets of end needles each comprising only one needle, the method provides to activate all the needles of the needle set in order to make up a course by knitting, with the only needle of the left set of end needles, a first elastic thread along with the main thread and holding the first elastic thread on the only needle of the left set of end needles; by knitting through the middle needles the main thread; and/or by knitting through the only needle of the right set of end needles a second elastic thread along with the main thread and holding the second elastic thread on the only needle of the right set of end needles. Then carry on by activating all needles of said needle set to make up a subsequent course by knitting, through the only needle of the right set of end needles, the second elastic thread along with the main thread and holding the second elastic thread on the only needle of the right set of end needles; by knitting, through the middle needles, the main thread; and by knitting, through the only needle of the left set of end needles, the first elastic thread along with the main thread and holding the first elastic thread on the only needle of the left set of end needles and so on until the required extent of the elastic portions is achieved. With this mode, elastic portions having extent in the orthogonal direction equal to a single stitch are obtained.

On the contrary, in case of sets of end needles both comprising at least two, preferably at least five or more needles, a matrix of stitches stretch in a direction orthogonal to the longitudinal direction is obtained, which comprises at least two, preferably at least five and more stretch stitches. The method provides to activate all needles of said needle set to make up a corresponding course by knitting, through the left set of end needles, a first elastic thread along with the main thread starting from a first outer end needle up to a first inner end needle and holding the first elastic thread on the first inner end needle; by knitting, through the middle needles, said main thread; and/or by knitting, through the needles of the right set of end needles, a second elastic thread along with the main thread, starting from a second inner end needle up to a second outer end needle and holding the second elastic thread on the second outer end needle. Then activate all needles of said needle set to make up a subsequent course by knitting, through the right set of end needles, the second elastic thread along with the main thread starting from the second outer end needle up to the second inner end needle and holding the second elastic thread on the second inner end needle; by knitting, through the middle needles, the main thread; and/or by knitting, through the needles of the left set of end needles, the first elastic thread along with the main thread, starting from the first inner end needle up to the first outer end needle and holding the first elastic thread on the first outer end needle.

In both cases, if elastic portions at both the right and left edges of the garment are intended to be obtained, two distinct elastic threads are provided, one intended to be knitted by the right set of end needles and one intended to be knitted by the left set of end needles in order to obtain, according to the needs, elastic portions at the left and right side edges. The use of two separate elastic threads, in fact, allows obtaining elastic portions in corresponding positions both at the right side edge and the left side edge, without the need of cutting the elastic threat at each course, which would lead to elastic portions each comprising a plurality of substantially transversal fragments of elastic thread cut at both the ends which would make the portion itself free from any effectiveness, or else without the need of having lengths of not-knitted thread between corresponding elastic portions at the right edge and the left edge, that would make the garment hardly wearable, as well as highly bothersome once worn.

Each elastic thread is then held on the only needle of the respective right or left end set, or on the respective inner or outer end needle of the right or left set of end needles at the end of every course, in order to prevent the elastic thread from being knitted by the other needles of the needle set and in order to be knitted again at the following knitted course by the needle/s only of the respective right or left end needle set. The elastic thread of each elastic portion extends therein substantially to form a serpentine which winds from a knitted course to another until the end of the elastic portion. After the end of the elastic portion, the elastic thread can be cut and not be knitted until the next elastic portion or else until a new use. Of course several main threads can be provided according to the knitting needs.

Preferably, the step needed to the making up of each elastic portion is carried out for at least ten, preferably at least twenty or more runs of the rotating cylinder in order to make up elastic portions of the side edge having a longitudinal extent corresponding to at least ten, preferably at least twenty and more stitches of the main thread, respectively. The larger is the longitudinal extent of each elastic portion the better the restraining effect of the respective right or left side edge will be.

Finally, before the initial step of making up a toe or heel portion and/or after the ending step of making up a heel or toe portion, one or more steps are provided for the making up a conventional elastic edge or else one or more steps described and claimed in the Italian Patent Application BS2013A000101, filed on Jul. 10, 2013, for the making up of a restraining band.

Advantageously the foot-covering garment can be made through any type of thread or yarn; additionally, the foot-covering garment can be of a single jersey type or have any type of knit or knitting which can be obtained with a circular machine for knitwear or hosiery.

In a further aspect the invention also relates to a circular machine for knitwear or hosiery comprising a rotating cylinder able to be selectively and rotationally activated in reciprocating motion, carrying a plurality of needles able to be selectively activated, and a thread feeding station provided with main feeding means to feed at least one main thread, first feeding means to feed at least one first elastic thread and/or second feeding means to feed at least one second elastic thread, selecting means to selectively activate the needles, wherein each needle of the rotating cylinder is able to be selectively activated to intercept and knit knitted courses of only the at least one main thread, or the first elastic thread along with the at least one main thread, or the second elastic thread along with the at least one main thread to respectively make up stitches of only the at least one main thread, or else stretch stitches composed of the first or second elastic thread along with the at least one main thread, which stretch stitches are located at an end of knitted courses to form elastic portions of the right and/or left edges of the foot-covering garment obtainable by means of the machine.

The presence of distinct feeding means for the first and the second elastic thread allows making elastic portions in any part of the right and left side edges.

Preferably said first feeding means of the first elastic thread and said second feeding means of the second elastic thread are placed on opposite sides with respect to said main feeding means of the main thread.

In this way it is avoided that the first/second elastic thread, held from time to time on the respective inner end needle, crosses the second/first elastic thread during the rotations of the rotating cylinder, avoiding in such way the eventual knotting of the elastic threads.

Moreover, thanks to this arrangement of the supply means of the elastic threads, the first elastic thread is kept away from the needle/needles of the right set of end needles to prevent it from being worked by them causing an error in the garment and, correspondingly, the second elastic thread is kept away from the needle/needles of the left set of end needles.

Preferably, the selecting means comprise actuators, for example cams, and respective program means programmed to implement the above described method.

BRIEF DESCRIPTION OF THE DRAWINGS

The invention will be therefore further illustrated in the following in the description made referring to the accompanying indicative and not limitative drawings, in which.

DETAILED DESCRIPTION OF THE DRAWINGS

Figures 1, 2A, 2B:
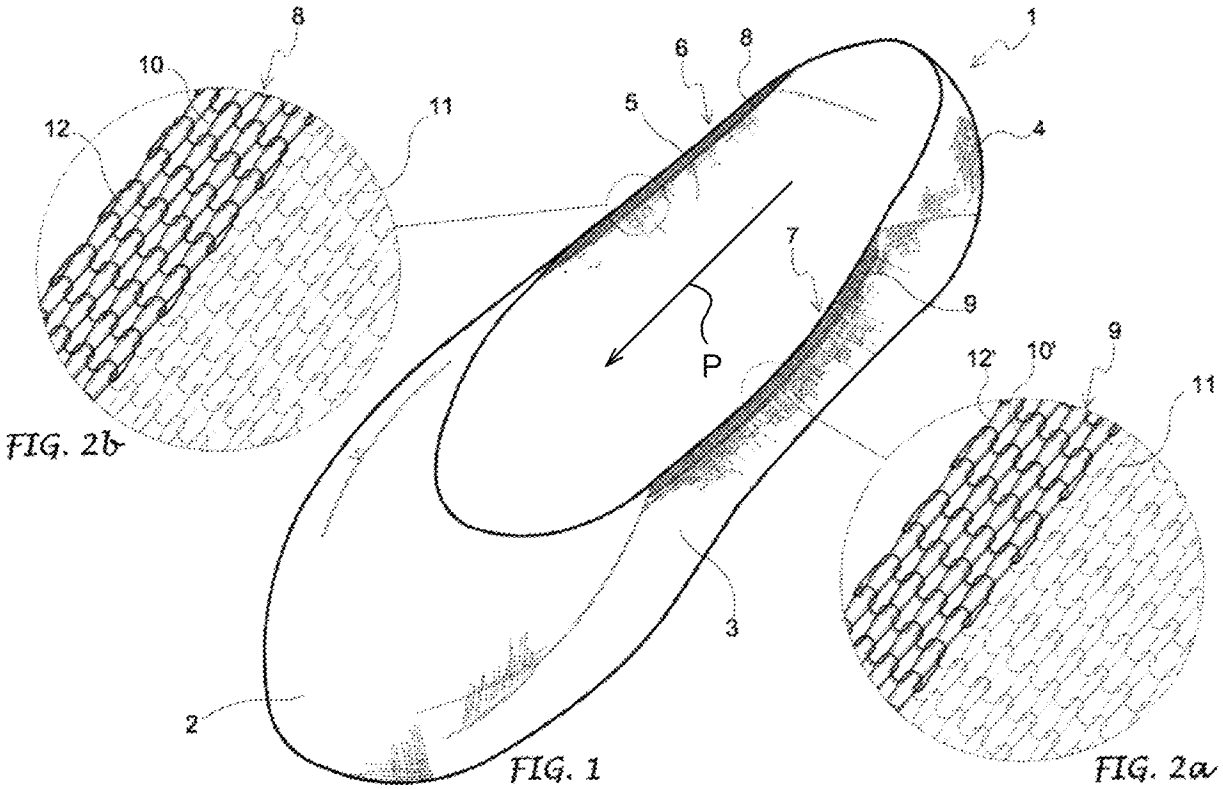
FIG. 1 shows a perspective view of a foot-covering garment according to the present invention.
FIGS. 2*a* and 2*b* show the enlarged details circled in FIG. 1.

In said drawings, by the numeral 1 a foot-covering garment is indicated as a whole, which is obtained by knitting at least one main thread 11 and formed in one piece, i.e. seamlessly. The foot-covering garment comprises a toe portion 2, a middle portion 3 ending with a right side edge 6 and a left side edge 7, a heel portion 4 and an opening 5 defined by said portions, for allowing the insertion of a user foot. The toe portion and the heel portion are aligned along a longitudinal direction indicated by arrow P.

According to the invention the foot-covering garment is provided with at least one elastic portion 8, 9 next to at least one of the right and left side edges. Such elastic portions 8, 9 can be provided at the right side edge 6 only or the left side edge 7 only, both intended to contact one of the two sides of a user's foot, or else at both sides. Furthermore, at the right side edge 6 only one elastic portion 8 can be provided, extending for the whole length of the edge itself, or else only at a part thereof. Alternatively or additionally, also the left side edge 7 can have only one elastic portion 9 extending for the whole length of the edge itself, or else only at a part thereof.

Preferably, as shown in FIG. 1, the garment has two restraining portions 8, 9, both extending at the respective right 6 and left 7 side edges.

Figure 3:
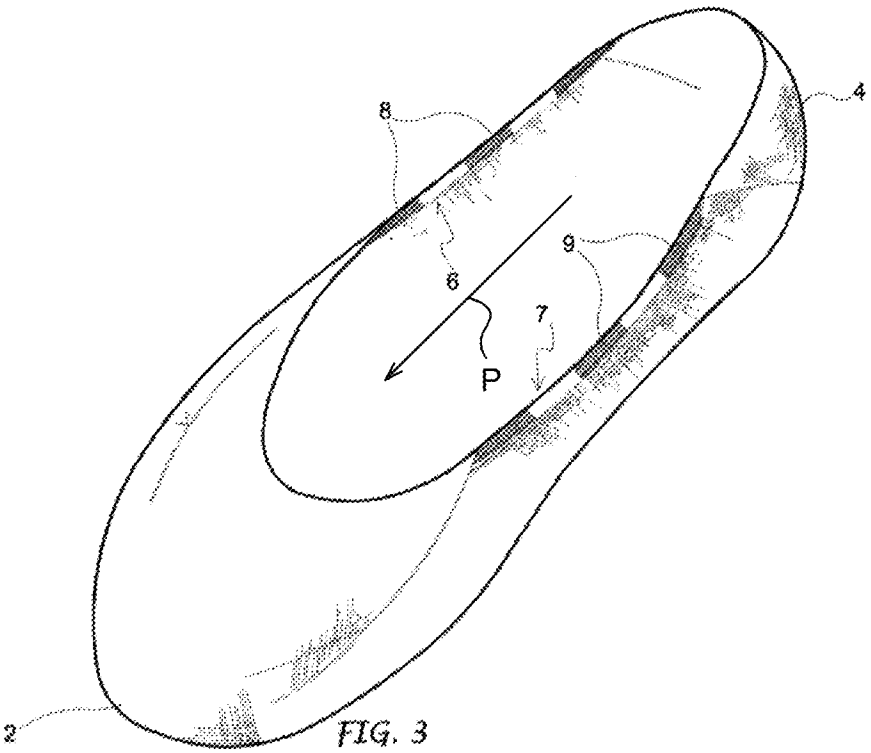
FIG. 3 shows a perspective view of a foot-covering garment according to a different embodiment of the present invention.

In another embodiment—FIG. 3, at the right side edge 6, two or more elastic portions 8 can be provided as aligned along the longitudinal direction and interspaced by portions of the right side edge 6. Alternatively or additionally, also the left side edge 7 can have two or more elastic portions 9 aligned in the longitudinal direction indicated by arrow P and interspaced by portions of left side edge.

Each elastic portion 8, 9 is made up of a plurality of stretch stitches 10, 10' arranged in succession in the longitudinal direction indicated by arrow P and composed of at least one main thread 11 of the foot-covering garment 1, knitted with at least one elastic thread 12, 12'.

Each elastic portion 8 of the right side edge can, for example, be constituted by stretch stitches to composed of the main thread 11 and a first elastic thread 12, whereas each elastic portion 9 of the left side edge can, for example, be constituted by stretch stitches 10' composed of the main thread 11 and a second elastic thread 12'.

Advantageously, each elastic thread 12, 12' extends with no interruption in each elastic portion 8, 9, as visible in FIGS. 2*a* and 2*b*, showing enlarged portions of to the two free ends of the middle portion, provided with respective elastic portions. This means that the elastic thread 12, 12' is not cut at each knitted course of the elastic portion 8, 9, but is made as a single length winding a serpentine between subsequent knitted courses substantially by following it, starting from the start and up to the end of the respective elastic portion. Each length of elastic thread of each elastic portion can thus have two cut ends, one at the start of the first stretch stitch of the first knitted course and the other one at the end of the last stretch stitch of the last knitted course of the series of stretch stitches of the knitted courses composing each elastic portion.

Figure 5:
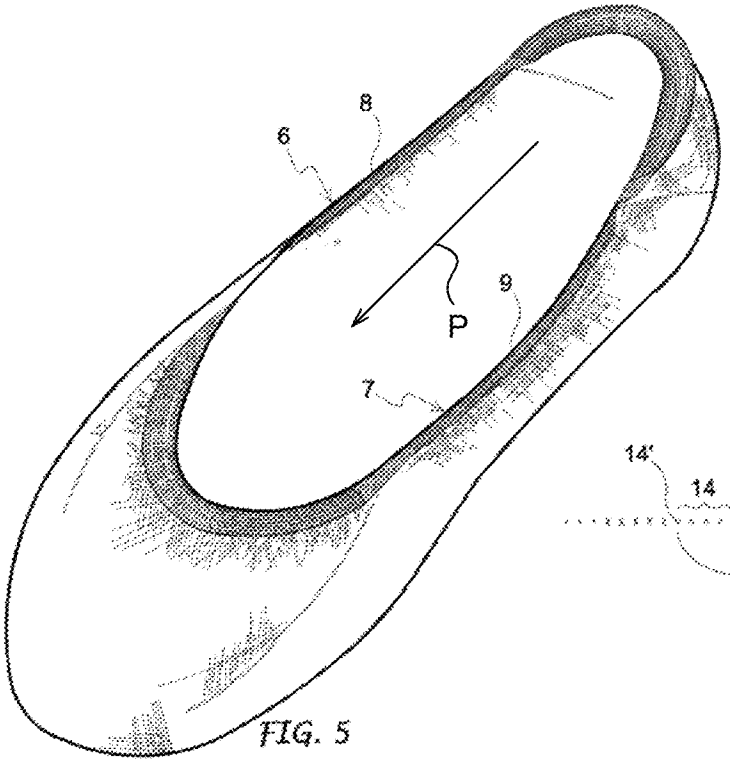
FIG. 5 shows a perspective view of a foot-covering garment according to the present invention provided with elastic edges according to the known art.

Each elastic portion 8, 9 is composed of a matrix of stretch stitches to, 10', i.e. a series of columns of one or more stretch stitches to, 10', each one corresponding to a part of a respective knitted course that, in a direction orthogonal to the longitudinal direction indicated by arrow P, comprises at least two stretch stitches to, 10'. Preferably the elastic portions 8, 9 extend, in the orthogonal direction, for five or more elongated stitches to, 10'. The afore described foot-covering garment can further comprise, at the toe 2 and/or heel 4 portions, a conventional elastic edge—as shown in FIG. 5.

Figure 6:
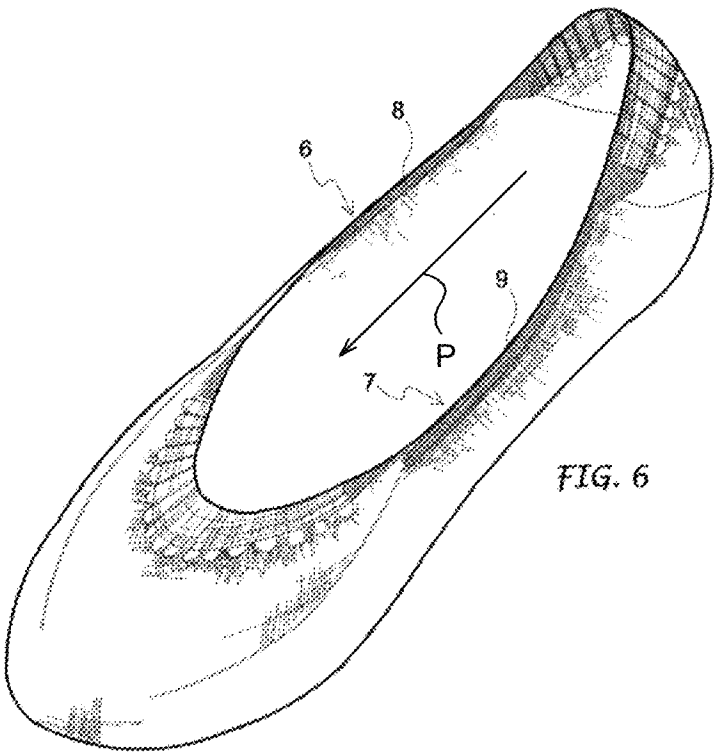
FIG. 6 shows a perspective view of a foot-covering garment according to the present invention provided with restraining portions.
Figure 7B:
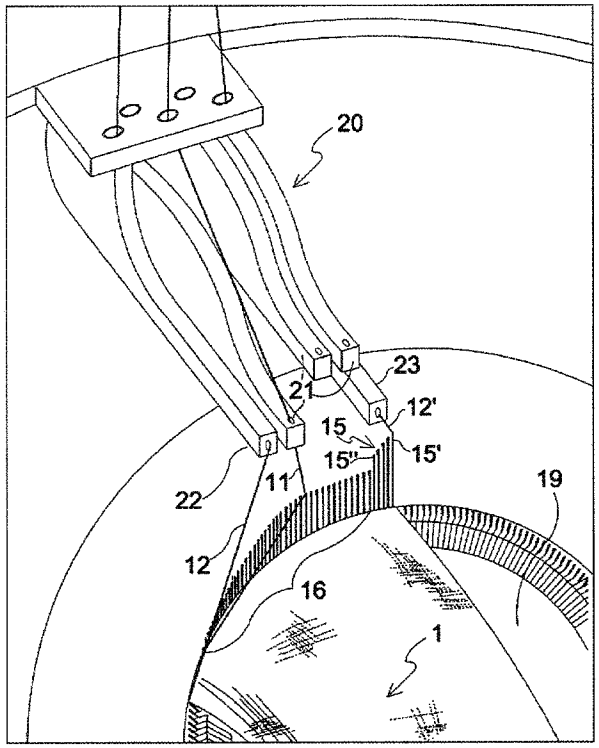
FIGS. 7*a* and 7*b* show a part of a circular machine for knitwear and hosiery in two different steps of manufacturing the foot-covering garment according to the present invention.
Figure 7A:
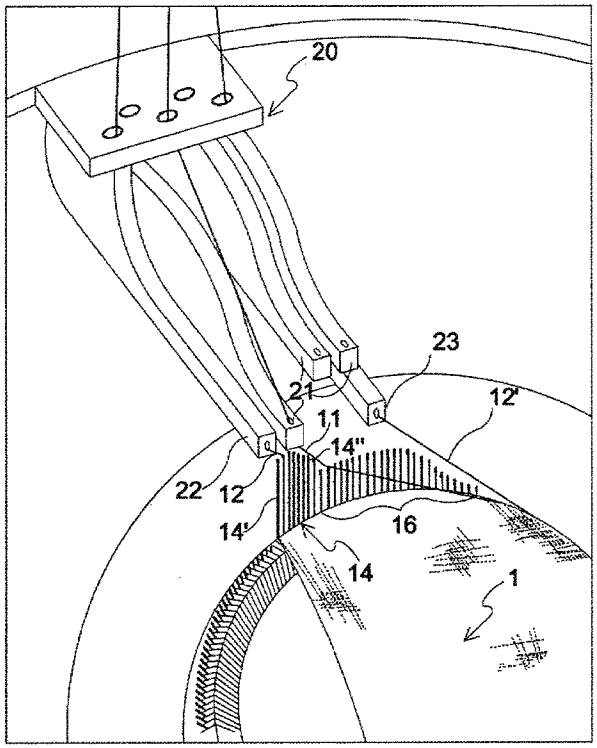

Alternatively, as shown in FIG. 6, the foot-covering garment according to the present invention can be provided with a restraining portion at the heel portion 4 and/or at the toe portion 2, as described and claimed in the Patent Application BS2013A000101, filed on Jul. 10, 2013, by the same Applicant.

The invention further refers to a method for making a seamless foot-covering garment 1 made of knitted courses as described above, wholly on a circular machine for knitwear or hosiery provided with a rotating cylinder 19 able to be selectively and rotationally activated in reciprocating motion, carrying a plurality of needles able to be selectively activated, and provided with means for feeding at least one main thread 11 and at least one elastic thread 12, 12' to the needles.

In detail, the method provides the following steps:

a) knitting at least one main thread 11 through part of the needles of the rotating cylinder activated in reciprocating motion, in order to realize a toe portion 2 or a heel portion 4 of the foot-covering garment;

b) at the end of the step a) knitting at least one main thread 11 through a needle set 13 of the rotating cylinder, activated in reciprocated motion, to realize the middle portion 3 with the respective right 6 and left 7 side edges, wherein said needle set 13 comprises a left set of end needles 14, composed of one or more needles, a right set of end needles 15, composed of one or more needles, and a plurality of middle needles 16 with respect to the left set of end needles 14 and the right set of end needles 15, c) at the end of step b) knitting at least one main thread 11 through part of the needles of the rotating cylinder activated in reciprocating motion, in order to realize the heel portion 4 or the toe portion 2, respectively, of the foot-covering garment 1, wherein the toe and heel portions are aligned along a longitudinal direction indicated by arrow P.

According to the invention it is provided the step of:

b') during the step b) and during at least two runs, preferably consecutive, of the rotating cylinder, activating all the needles of said needle set 13 in order to making up two corresponding knitted courses and feed, to the needle/s of the left set of end needles 14 and/or to the needle/s of the right set of end needles 15, a respective elastic thread 12, 12' along with at least one main thread 11, to make up at least one elastic portion of the left and/or right side 8, 9 composed of a plurality of stretched stitches 10 of at least one main thread 11 and of the elastic thread 12, 12'.

The making up of the foot covering garment can start indifferently, as usual, with the composing of a toe or heel portion according to known art.

Figure 4:
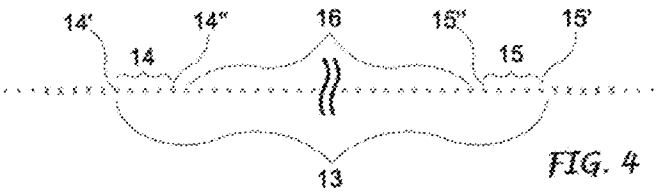
FIG. 4 shows a simplified scheme of the needles of the rotating cylinder.

In FIG. 4 a simplified scheme of the needles of the rotating cylinder is shown, for the sake of simplicity arranged in line rather than along a circumference. By a small dot the needles of the needle set 13 used during the making up of the middle portion are represented, whereas by a small cross other needles of the rotating cylinder, which are not used for the making up of the middle portion, are represented. The ellipsis indicates that only part of the needles used are represented which compose the needle set 13 and only part of the not used needles. As a matter of fact and only by way of example, for the manufacture of a foot-covering garment according to the invention, circular machines for hosiery can be used with a rotating cylinder having a diameter of 3.75 inches and provided with a number of needles comprised between 200 and 400, depending on the type of used thread and the fineness of the foot-covering garment to make, of which a number comprised between 150 and 350 is used and the remaining are unused, i.e. out of work, during the making up of the garment itself. The needle set 13 comprises in its turn a left set of end needles 14 and a right set of end needles 15, both composed of one or more needles, and a set of middle needles 16 with respect to the left and right end needle sets. All the afore mentioned needles can be of the same typology and have the same features and be needles usually employed in the circular machines of the herein considered typology. They have been subdivided into sets only in order to describe the method of the present invention.

Each needle of the respective left or right set of end needles 14, 15 is conveniently selected in order to intercept and knit the corresponding elastic thread 12, 12', when fed, along with at least one main thread 11 in order to form a respective elastic portion 8, 9, or to intercept and knit the main thread/s only at lengths of the elastic edge 6, 7 where no elastic portion is provided, or in other portions of the foot-covering garment.

In case both left and/or right set of end needles 14, 15 comprise only one end needle and the step b' provides to:

activate all needles of said needle set 13 to make up a corresponding knitted course by working, i.e. by knitting, through the only needle of the left set of end needles 14, a first elastic thread 12 along with the main thread 11 and holding the first elastic thread 12 on the only needle of the left set of end needles 14, by knitting, through the middle needles 16, the main thread 11 and/or knitting, to through the only needle of the right set of end needles 15, a second elastic thread 12' along with the main thread 11 and holding the second elastic thread 12' on the only needle of the right set of end needles 15;

afterwards, activate all needles of said needle set 13 to make up a corresponding course by knitting, through the only needle of the right set of end needles 15, the second elastic thread 12' along with the main thread 11 and holding the second elastic thread 12' on the only needle of the right set of end needles 15, by knitting, through the middle needles 16, the main thread 11 and knitting, through the only needle of the left set of end needles 14, the first elastic thread 12 along with the main thread 11 and holding the first elastic thread 12 on the only needle of the left set of end needles 14.

Since both left and right sets of end needles 14, 15 comprise only one needle, which thus is the only one to knit the corresponding elastic thread, corresponding elastic portions 8, 9 are obtained that, in a direction orthogonal to the longitudinal direction indicated by arrow P, have both an extent equal to a single stitch. On the contrary, their longitudinal extent depends on the number of consecutive knitted courses in which step b') is carried out. Through this mode elastic portions are obtained, each composed of a kind of spiral of elastic thread.

Alternatively, each left and/or right set of end needles 14, 15 can comprise at least two, preferably at least five or more needles to define a matrix of stretch stitches 10, 10' that, in a direction orthogonal to the longitudinal direction, comprises at least two, but preferably at least five or more stretch stitches. The left and right sets of end needles 14, 15 both comprise two or more needles, comprised or composed of a first outer needle 14' and a first inner end needle 14", and a second outer needle 15' and a second inner end needle 15", respectively. Preferably, the left and/or right sets of end needles 14, 15 comprise at least five or more needles to define a matrix of stretch stitches 10, 10' that, in a direction orthogonal to the longitudinal direction indicated by arrow P, comprises at least five or more stretch stitches.

In this case the step b' provides to:

activate all the needles of said needle set 13 in order to make up a corresponding course by knitting through the left set of end needles 14 a first elastic thread 12 along with the main thread 11 starting from the first outer end needle 14' up to the first inner end needle 14" and holding the first elastic thread 12 on the first inner end needle 14", by knitting through middle needles 16 the main thread 11 and/or by knitting through the needles of the right set of end needles 15 a second elastic thread 12' along with the main thread 11, starting from the second inner end needle 15" up to the second outer end needle 15' and holding the second elastic thread 12' on the second outer end needle 15';

activate all needles of said needle set 13 to compose a corresponding course by knitting, through the right set of end needles 15, the second elastic thread 12' along with the main thread 11 starting from the second outer end needle 15' up to the second inner end needle 15" and holding the second elastic thread 12' on the second inner end needle 15", by knitting, through the middle needles 16, the only main thread 11 and/or knitting, through the needles of the left set of end needles 14, the first elastic thread 12 along with the main thread 11, starting from the first inner end needle 14" up to the first outer end needle 14' and/or holding the first elastic thread 12 on the first outer end needle 4.

Also in this case the longitudinal extent of each portion depends on the number of runs of the rotating cylinder at which the step b') is carried out. In fact and advantageously, the step b') is carried out for at least ten, preferably at least twenty or more consecutive runs of the rotating cylinder in order to obtain elastic portions 8, 9 of the side edge having a longitudinal extent corresponding to at least ten, preferably at least twenty or more stitches, respectively. In order to obtain more elastic portions at the same edge, it will be sufficient to carry out the step b' for a certain number of consecutive runs, carry on with runs in which also the needles of the sets of end needles do not intercept and, consequently, do not knit the corresponding elastic thread, then carry on with a new sequence of runs during which the step b') is carried out, and so on until obtaining the number of intended elastic portions.

Of course the entire garment, including the elastic edges, can be made with all stitches and knitting known in the field.

Finally, before the step a) of making up the toe and/or heel portion and/or after the step c) of making up the heel or toe portion, one or more steps are provided as needed for making up an elastic edge, as shown in FIG. 5.

In another embodiment—FIG. 6—before the step a) of making up the toe and/or heel portion and/or after the step c) of making up the heel or toe portions, one or more steps are provided described and claimed in the Italian Patent Application BS2013A000101, filed on Jul. 10, 2013.

In order to manufacture the foot-covering garment 1, a circular machine for knitwear or hosiery can be used as provided, as usual, with a rotating cylinder 19 able to be selectively and rotationally activated in a reciprocating motion and carrying a plurality of needles able to be individually selected. The machine also comprises a thread feeding station 20 provided with main feeding means 21 to feed at least one main thread 11 or ground yarn. In order to carry out the above described method, the thread feeding station further comprises first and/or second feeding means 22, 23 of at least one first and/or one second elastic thread 12, 12', respectively, and selecting means to selectively activate each needle of the rotating cylinder in order to intercept and knit the main thread 11 only, or else the first elastic thread 12 along with the main thread 11, or the second elastic thread 12' along with the main thread 11 in order to compose stitches of the main thread only, or stretch stitches 10, 10' respectively at the elastic portions 8, 9 of the right 6 and/or left 7 side edge of the foot-covering garment 1.

In order to select the needles, the machine is provided with selecting means having the shape of actuators, for example cams, and respective program means programmed to implement the method for manufacturing the foot-covering garment 1.

LIST OF REFERENCE NUMBERS

1 foot-covering garment
2 toe portion
3 middle portion
4 heel portion
5 opening
6 right side edge
7 left side edge
8 elastic portion
9 elastic portion
10 stretch stitch
10' stretch stitch
11 main thread
12 elastic thread
12' elastic thread
13 needle set
14 left set of end needles
15 right set of end needles
16 set of middle needles
14' first outer needle
14" first inner end needle
15' second outer needle
15" second inner end needle
19 cylinder
20 thread feeding station
21 main feeding means
22 first feeding means
23 second feeding means

The invention claimed is:

1. Foot-covering garment made of knitted courses, comprising a heel portion, a toe portion, a middle portion located between the heel portion and the toe portion and an opening between said heel portion, said middle portion and said toe portion for the insertion of an user's foot, wherein the toe portion and the heel portion are aligned along a longitudinal direction, and wherein at said opening the middle portion has a right side edge and a left side edge, which garment is seamlessly knitted as a whole, wherein at least one or both the right and left side edges comprise at least one elastic portion made up by a plurality of stretch stitches located at an end of knitted courses, which stretch stitches are composed of at least one main thread of the foot-covering garment knitted with at least one elastic thread wherein said elastic thread is present with no interruption between courses of said at least one elastic portion, in that it is not cut at an end of each knitted course of said at least one elastic portion.

2. Foot-covering garment according to claim 1, wherein at least one of the right side edge and the left side edge has only one elastic portion, said elastic portion extending for the whole length of the right or left side edge, respectively.

3. Foot-covering garment according to claim 1, wherein both the right side edge and the left side edge have an elastic portion.

4. Foot-covering garment according to claim 1, wherein:

wherein at least one of the right side edge and the left side edge has at least two elastic portions that are consecutive in the longitudinal direction, interspaced by a portion of the right or left side edge, respectively.

5. Garment according to claim 1, wherein each elastic portion is defined by a matrix of stretch stitches in the longitudinal direction, that, in a direction orthogonal to the longitudinal direction, comprises at least one stretch stitches.

6. Garment according to claim 1, wherein also at least one of the toe and heel portions comprise an elastic edge.

7. Method for manufacturing a seamless foot-covering garment made of knitted courses, wholly on a circular machine for knitwear or hosiery provided with a rotating cylinder able to be selectively and rotationally activated in reciprocating motion, carrying a plurality of needles able to be selectively activated, and provided with means for feeding at least one main thread and at least one elastic thread to the needles, comprising the steps of:

a) knitting at least one main thread through part of the needles of the rotating cylinder activated in reciprocating motion, in order to realize a toe portion or a heel portion of the foot-covering garment;

b) at the end of the step a) knitting at least one main thread through a needle set of the rotating cylinder, activated in reciprocating motion, in order to realize the middle portion with the respective right and left side edges, wherein said needle set comprises a left set of end needles, composed of one or more needles, and a right set of end needles, composed of one or more needles, and a plurality of middle needles with respect to the left and right sets of end needles, c) at the end of step b) knitting at least one main thread through part of the needles of the rotating cylinder activated in reciprocating motion, in order to realize the heel portion or the toe portion, respectively, of the foot-covering garment, wherein the toe and heel portions are aligned along a longitudinal direction, wherein:

b') during the step b) and during at least two runs of the rotating cylinder, activating all the needles of said needle set in order to make up two corresponding knitted courses and feed, to at least the needles of the left set of end needles and the needles of the right set of end needles, a respective elastic thread along with at least one main thread, to make up at least one elastic portion of the left edges and right edges composed of a plurality of stretched stitches located at an end of knitted courses, which stretch stitches are composed of at least one main thread and of the elastic thread, wherein said elastic thread extends as a single length with no interruption in each elastic portion, in that it is not cut at each knitted course of the elastic portion.

8. Method according to claim 7, wherein each left and/or right sets of end needles comprise only one end needle and the step b' provides to:

activate all the needles of said needle set in order to make up a corresponding course by knitting through the only needle of the left set of end needles a first elastic thread along with the main thread and holding the first elastic thread on the only needle of the left set of end needles, by knitting through the middle needles the main thread and/or by knitting through the only needle of the right set of end needles a second elastic thread along with the main thread and holding the second elastic thread on the only needle of the right set of end needles;

afterwards, activate all needles of said needle set in order to make up a corresponding course by knitting through the only needle of the right set of end needles the second elastic thread along with the main thread and holding the second elastic thread on the only needle of the right set of end needles, by knitting through the middle needles the main thread and by knitting through the only needle of the left set of end needles the first elastic thread along with the main thread and holding the first elastic thread on the only needle of the left set of end needles.

9. Method according to claim 7, wherein each left and/or right sets of end needles comprise at least two needles in order to define a matrix of stretch stitches that, in a direction orthogonal to the longitudinal direction comprises at least two stretch stitches and the step b' provides to:

activate all the needles of said needle set in order to make up a corresponding course by knitting through the left set of end needles a first elastic thread along with the main thread starting from a first outer end needle up to a first inner end needle and holding the first elastic thread on the first inner end needle, by knitting through the middle needles the main thread and/or by knitting through the needles of the right set of end needles a second elastic thread along with the main thread, starting from a second inner end needle up to a second outer end needle and holding the second elastic thread on the second outer end needle;

activate all the needles of said needle set in order to make up a corresponding course by knitting through the right set of end needles the second elastic thread along with the main thread starting from the second outer end needle up to the second inner end needle and holding the second elastic thread on the second inner end needle, by knitting through the middle needles the main thread only and/or by knitting through the needles of the left set of end needles the first elastic thread along with the main thread, starting from the first inner end needle up to the first outer end needle and/or holding the first elastic thread on the first outer end needle.

10. Method according to claim 7, wherein the step b') is carried out for at least ten consecutive runs of the rotating cylinder in order to make up elastic portions of the side edge having a longitudinal extent corresponding to at least ten stitches, respectively.

11. Method according to claim 7, wherein before the step a) and/or after the step c) one or more steps of making up an elastic edge are provided.

12. Foot-covering garment according to claim 1, wherein at least one of the right side edge and the left side edge has only one elastic portion, said elastic portion extending over a part of for the whole length of the right or left side edge, respectively.

* * * * *